US009687689B2

(12) United States Patent
Lin

(10) Patent No.: US 9,687,689 B2
(45) Date of Patent: Jun. 27, 2017

(54) DAMPING DEVICE

(71) Applicant: Global WIN Technology Co., Ltd., Taipei (TW)

(72) Inventor: Shih-Jen Lin, Taipei (TW)

(73) Assignee: GLOBAL WIN TECHNOLOGY CO., LTD., Taipei (TW)

( * ) Notice: Subject to any disclaimer, the term of this patent is extended or adjusted under 35 U.S.C. 154(b) by 56 days.

(21) Appl. No.: 14/799,288

(22) Filed: Jul. 14, 2015

(65) Prior Publication Data

US 2017/0014661 A1 Jan. 19, 2017

(51) Int. Cl.

| | |
|---|---|
| ***A63B 21/018*** | (2006.01) |
| ***A63B 21/22*** | (2006.01) |
| ***A63B 21/005*** | (2006.01) |
| *A63B 21/00* | (2006.01) |
| *A63B 22/00* | (2006.01) |

(52) U.S. Cl.

CPC ..... *A63B 21/018* (2013.01); *A63B 21/005* (2013.01); *A63B 21/153* (2013.01); *A63B 21/22* (2013.01); *A63B 21/0051* (2013.01); *A63B 21/0052* (2013.01); *A63B 21/00069* (2013.01); *A63B 21/151* (2013.01); *A63B 21/4035* (2015.10); *A63B 2022/0079* (2013.01); *A63B 2209/08* (2013.01)

(58) Field of Classification Search

CPC ..... A63B 21/00069; A63B 21/00072; A63B 21/005; A63B 21/0051; A63B 21/0052; A63B 21/0056; A63B 21/0057; A63B 21/018; A63B 21/15; A63B 21/151; A63B 21/152; A63B 21/153; A63B 21/22; A63B 21/222; A63B 21/225; A63B 21/227; A63B 21/4035; A63B 2022/0079; A63B 2209/08

See application file for complete search history.

(56) References Cited

U.S. PATENT DOCUMENTS 4,239,092 A * 12/1980 Janson ..... F16D 27/01 188/267
4,261,562 A * 4/1981 Flavell ..... A63B 21/0053 482/6
4,529,196 A * 7/1985 Logan ..... A63B 21/0051 482/8

(Continued)

*Primary Examiner* — Joshua Lee
(74) *Attorney, Agent, or Firm* — Muncy, Geissler, Olds & Lowe, P.C.

(57) ABSTRACT

A damping device includes a casing structure, a retarding mechanism, a driving mechanism, a restoring mechanism and a resistance mechanism. An accommodating space is formed in the casing structure to accommodate the retarding mechanism, and a through hole and a hollow-out hole are formed at wall surfaces of two opposite sides of the accommodating space respectively. The retarding mechanism has a main shaft passed through out of the through hole, and a retarding shaft acting simultaneously with the main shaft. The driving mechanism has a wire wheel fastened on the main shaft. The restoring mechanism has a restoring wheel fastened on the wire wheel. The resistance mechanism has a metal element fastened on the retarding shaft, and a magnetic part is disposed between the metal element and the hollow-out hole, and an interval is formed between the magnetic part and the metal element.

12 Claims, 10 Drawing Sheets

(56) References Cited

U.S. PATENT DOCUMENTS

| | | | | | |
|---|---|---|---|---|---|
| 5,051,638 | A * | 9/1991 | Pyles | A63B 21/0051 | 310/105 |
| 5,176,599 | A * | 1/1993 | Beliakov | A63B 21/00192 | 482/148 |
| 5,180,348 | A * | 1/1993 | Saarinen | A63B 21/0051 | 482/6 |
| 5,409,435 | A * | 4/1995 | Daniels | A63B 21/00845 | 482/5 |
| 7,011,607 | B2 * | 3/2006 | Kolda | A63B 21/0051 | 482/57 |
| 8,647,239 | B1 * | 2/2014 | Sokolovas | A63B 69/10 | 482/55 |
| 2003/0087735 | A1 * | 5/2003 | Chen | A63B 21/025 | 482/116 |
| 2004/0102292 | A1 * | 5/2004 | Pyles | A63B 21/0051 | 482/54 |
| 2009/0036276 | A1 * | 2/2009 | Loach | A63B 21/15 | 482/72 |
| 2012/0053014 | A1 * | 3/2012 | Zhu | A63B 21/00069 | 482/5 |
| 2014/0113779 | A1 * | 4/2014 | Loach | A63B 21/0004 | 482/115 |
| 2014/0357457 | A1 * | 12/2014 | Boekema | A63B 21/00069 | 482/124 |
| 2015/0011368 | A1 * | 1/2015 | Manor | A63B 21/0051 | 482/116 |
| 2016/0325132 | A1 * | 11/2016 | Nelson | A63B 21/4035 | |

* cited by examiner

DAMPING DEVICE

BACKGROUND OF THE INVENTION

1. Field of the Invention

The present disclosure relates to a damping device, more particularly to a damping device in which an interval is formed between a metal element and a magnetic part to make the rotating metal element not contact with the magnetic part and avoid generating any wear. In addition, the magnitude of a pulling force for the damping device can be adjusted by adjusting a distance between the metal element and the magnetic part without using electric power. Therefore, the life time and carrying convenience of the damping device of the present disclosure can be improved and the noise generated by the damping device of the present disclosure can be reduced.

2. Description of the Related Art

Today, as health consciousness surges, the people pay more attention on body health. Apart from taking care of nutrition absorption of the body in food and drink, the people also train muscles of each of the body portions by executing work-out. Therefore, the modem people are more concerned about how to improve self-owned muscle strength, endurance and etc.

Most of various fitness apparatuses are provided with pulling wires which are disposed on the machine frames and guided to turn by multiple pulleys. A resistance device is disposed at an end of the pulling wire; and the user can hold other end of the pulling wire to pull or push against the resistance, so as to complete the muscle strength training.

Apart from the device formed by multiple weight stacks, the device configured to generate the resistance can also be formed by a transmission device. The transmission device includes a shaft, a metal element mounted at an end of the shaft, and a magnet piece disposed adjacent to the metal element. An underdriving gear set is connected to other end of the shaft and further connected to a wire wheel which is used to roll and accommodate the pulling wire.

In practical application, the transmission device first electrifies the magnet piece to make the magnet piece and the metal element be attracted to contact with each other, and the magnetic attraction of the magnet piece for the metal element is adjusted by the electric power inputted into the magnet piece. When the user pulls the pulling wire to drive rotation of the wire wheel, the wire wheel drives the shaft to rotate via the underdriving gear set. Because the metal element and the magnet piece are attracted to contact with each other, the user must apply a pulling force larger than the magnetic attraction to rotate the metal element at the end of the shaft on the surface of the magnet piece, so as to complete the strength training action one time.

However, the metal element and the magnet piece are attracted to contact with each other, so the metal element is driven to rotate on the surface of the magnet piece for many times while user works out with the fitness equipment formed by the transmission device. Therefore, wears may be generated between the metal element and the magnet piece and noise may also be generated, and the life time of the fitness equipment is also decreased. In addition, the fitness equipment requires the electric power for operation, so it is not easy for the user to move the fitness equipment to other position for use, and hardly to carry the fitness equipment to outdoors for use.

Therefore, how to solve the problem that the metal element being rotated on the surface of the magnet piece causes the decreasing of the life time of the fitness equipment, and the problems of hardly reducing noise and very bad portability, is an important subject to study in the related technology.

SUMMARY OF THE INVENTION

To solve the problems, the inventor collects related data and performs many tests based on long-term experience, and finally designs a damping device in which an interval is formed between the metal element and the magnetic part, to improve the life time and portability of the damping device.

Main objective of the present disclosure is to provide a damping device. In the damping device, an interval is formed between the metal element and the magnetic part, and an adjusting member is inserted into the hollow-out hole from the outside of the casing structure to pivotally link with the magnetic part. In practical application, the adjusting member can be used to drive the load plate close to or away from the metal element, so as to increase or reduce a length of the interval and adjust the magnetic attraction of the magnetic part for the metal element correspondingly, whereby the strength of the pulling force for the pulling handle can be relatively adjusted. When the user pulls the pulling wire of the wire wheel to execute strength training, because the interval is formed between the metal element and magnetic part, the metal element and the magnetic part are not contacted with each other, no wear can be generated, and the damage caused on the resistance mechanism can also be reduced. Moreover, the damping device of the present disclosure can be operated without electric power, and the strength of the pulling force can be adjusted by the distance between the metal element and the magnetic part, so the effect of reducing noise and improving portability can be achieved.

BRIEF DESCRIPTION OF THE DRAWINGS

The detailed structure, operating principle and effects of the present disclosure will now be described in more details hereinafter with reference to the accompanying drawings that show various embodiments of the present disclosure as follows.

DETAILED DESCRIPTION OF THE PREFERRED EMBODIMENTS

Figure 1:
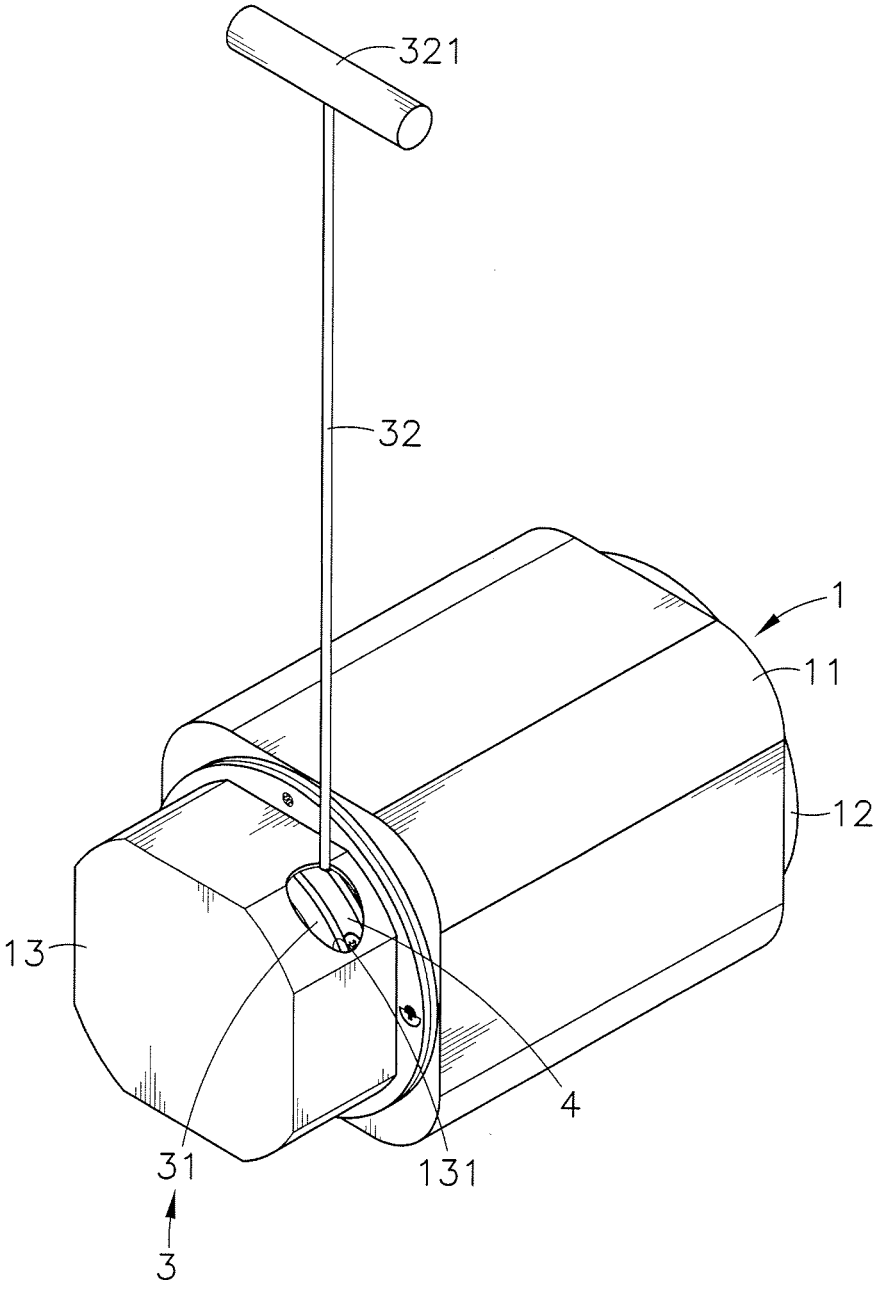
FIG. 1 is a perspective appearance view of the present disclosure.

Reference will now be made in detail to the exemplary embodiments of the present disclosure, examples of which are illustrated in the accompanying drawings. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. These embodiments are provided so that this disclosure will be thorough and complete, and will fully convey the inventive concept to those skilled in the art. The relative proportions and ratios of elements in the drawings may be exaggerated or diminished in size for the sake of clarity and convenience in the drawings, and such arbitrary proportions are only illustrative and not limiting in any way. The same reference numbers are used in the drawings and the description to refer to the same or like parts.

It will be understood that, although the terms 'first', 'second', 'third', etc., may be used herein to describe various elements, these elements should not be limited by these terms. The terms are used only for the purpose of distinguishing one component from another component. Thus, a first element discussed below could be termed a second element without departing from the teachings of embodiments. As used herein, the term "or"includes any and all combinations of one or more of the associated listed items.

Please refer to FIG. 1 through FIG. 4 which show perspective appearance view, exploded view, other exploded view from other view angle and lateral section view (A) respectively. The damping device of the present disclosure includes a casing structure 1, a retarding mechanism 2, a driving mechanism 3, a restoring mechanism 4 and a resistance mechanism 5.

The casing structure 1 includes a base 11, a cover 12 and a covering structure 13. The base 11 is provided with an accommodating space 110 formed therein, an opening 1100 formed at one side of the accommodating space 110, a through hole 111 formed on an central area of a wall surface of other side opposite to the opening 1100, and a sleeved groove 112 protrudingly disposed at periphery surface of the through hole 111 toward the accommodating space 110. An outer diameter of the sleeved groove 112 is larger than an outer diameter of the through hole 111. The cover 12 can be assembled with the opening 1100 and provided with a hollow-out hole 121 formed at a central area thereof corresponding to the through hole 111, and an annular positioning member 122 protrudingly disposed at periphery surface of the hollow-out hole 121. The annular positioning member 122 is provided with a plurality of positioning slots 1221 disposed at a top surface thereof. One or more bearing 1222 is mounted at an inner side of the annular positioning member 122. The covering structure 13 can be mounted at the outside of the through hole 111 of the base 11, and provided with an accommodating groove 130 concavely formed at a side thereof, and the accommodating groove 130 is provided with an outlet hole 131 disposed on an inner side wall thereof and communicated with the outside.

The retarding mechanism 2 is provided with a main shaft 21 disposed at a side thereof, and a retarding shaft 22 disposed at other side thereof and acting simultaneously with the main shaft 21.

The retarding mechanism 2 can be formed by an underdriving gear set, so that during the simultaneous action between the main shaft 21 and the retarding shaft 22 the revolution number of the main shaft 21 can be larger than the revolution number of the retarding shaft 22 or smaller than the revolution number of the retarding shaft 22, as long as revolution number of the main shaft 21 is different from that of the retarding shaft 22. It should be noted that the technology related to the underdriving gear set is a traditional technology, and the detailed integration is not the key point of the present disclosure, so the detailed description is omitted.

The driving mechanism 3 includes a wire wheel 31 which is disposed at a central area thereof and has a first axis hole 311. The wire wheel 31 is provided with a clamping groove 312 concavely disposed at a side surface of a central area thereof and an outer diameter of the clamping groove 312 is larger than that of the first axis hole 311. The wire wheel 31 is provided with a wire slot 313 formed at a peripheral thereof, and a pulling wire 32 is rolled and accommodated in the wire slot 313. An end of the pulling wire 32 is fastened in the wire slot 313, and a pulling handle 321 is mounted at other end of the pulling wire 32.

The restoring mechanism 4 is provided with a restoring wheel 41 at a side thereof, and the restoring wheel 41 is provided with a ring-like protrudent block 411 protrudingly disposed at peripheral of top thereof and a channel 42 formed at a central area thereof toward other side.

The restoring mechanism 4 can be a wind-up restoring spring box, the restoring wheel 41 can be a ratchet, and the restoring mechanism 4 is provided with a coil spring (not shown in FIGs) disposed inside thereof and incorporating with operation of the restoring wheel 41, to enable the restoring wheel 41 to be automatically rolled toward other side for restoring after the restoring wheel 41 is revolved toward a side. It should be noted that the wind-up restoring spring box is a traditional technology, and the detailed integration is not the key point of the present disclosure, so the detailed description is omitted.

The resistance mechanism 5 includes a metal element 51, a magnetic part 52 and an adjusting member 53. The metal element 51 is in a disk shape and provided with a second axis hole 511 at a central area thereof. The magnetic part 52 has a load plate 521. The load plate 521 is provided with an inner threaded hole 5211 at a central area thereof, and a plurality of positioning pillars 5212 protrudingly disposed at a side surface thereof, and a plurality of load holes passed through a surface thereof and arranged along a side edge thereof. Each of the load holes 5213 is assembled and fastened with a magnet 522 inside. The adjusting member 53 can be an adjusting bolt 531 which is provided with an outer screw thread 5311 formed at a side thereof and a head portion 5312 formed at other side thereof.

Please refer to FIGS. 2, 4 5 and 8 which show exploded view, lateral section views (A) and (B) and exploded view of other embodiment of the present disclosure respectively. In accordance with the present disclosure, during assembly, the retarding mechanism 2 is clamped and positioned inside the sleeved groove 112 of the base 11, to enable the main shaft 21 of the retarding mechanism 2 to pass through the through hole 111. The restoring mechanism 4 is assembled at a bottom of the base 11, to fasten the ring-like protrudent block 411 of the restoring wheel 41 in the clamping groove 312 of the wire wheel 31. The main shaft 21 of the retarding mechanism 2 is suspended in the channel 42, inserted and fastened in the axis hole 311 of the wire wheel 31. Next, the covering structure 13 is assembled at the bottom of the base 11 to enable the driving mechanism 3 and the restoring mechanism 4 to be accommodated in the accommodating groove 130 of the covering structure 13. The pulling wire 32 is passed through the outlet hole 131 of the covering structure 13. The retarding shaft 22 of the retarding mechanism 2 is inserted and fastened in the second axis hole 511 of the metal element 51. Moreover, the plurality of positioning pillars 5212 of the load plate 521 are inserted into the plurality of positioning slots 1221 at the top of the annular positioning member 122 of the cover 12, so that the adjusting bolt 531 can be passed through the hollow-out hole 121 of the cover 12 and then screwed into the inner threaded hole 5211 of the load plate 521. One or more the bearing 1222 mounted at the inner side of the annular positioning member 122 is sleeved onto the adjusting bolt 531, and the head portion 5312 of the adjusting bolt 531 is clamped against the outer surface of the hollow-out hole 121 of the cover 12. Next, the cover 12 is assembled at the opening 1100 of the base 11, so that an interval 6 can be formed between the metal element 51 and the load plate 521. Therefore, the damping device of the present disclosure can be formed by integration of the casing structure 1, the retarding mechanism 2, the driving mechanism 3, the restoring mechanism 4 and the resistance mechanism 5.

Figure 2:
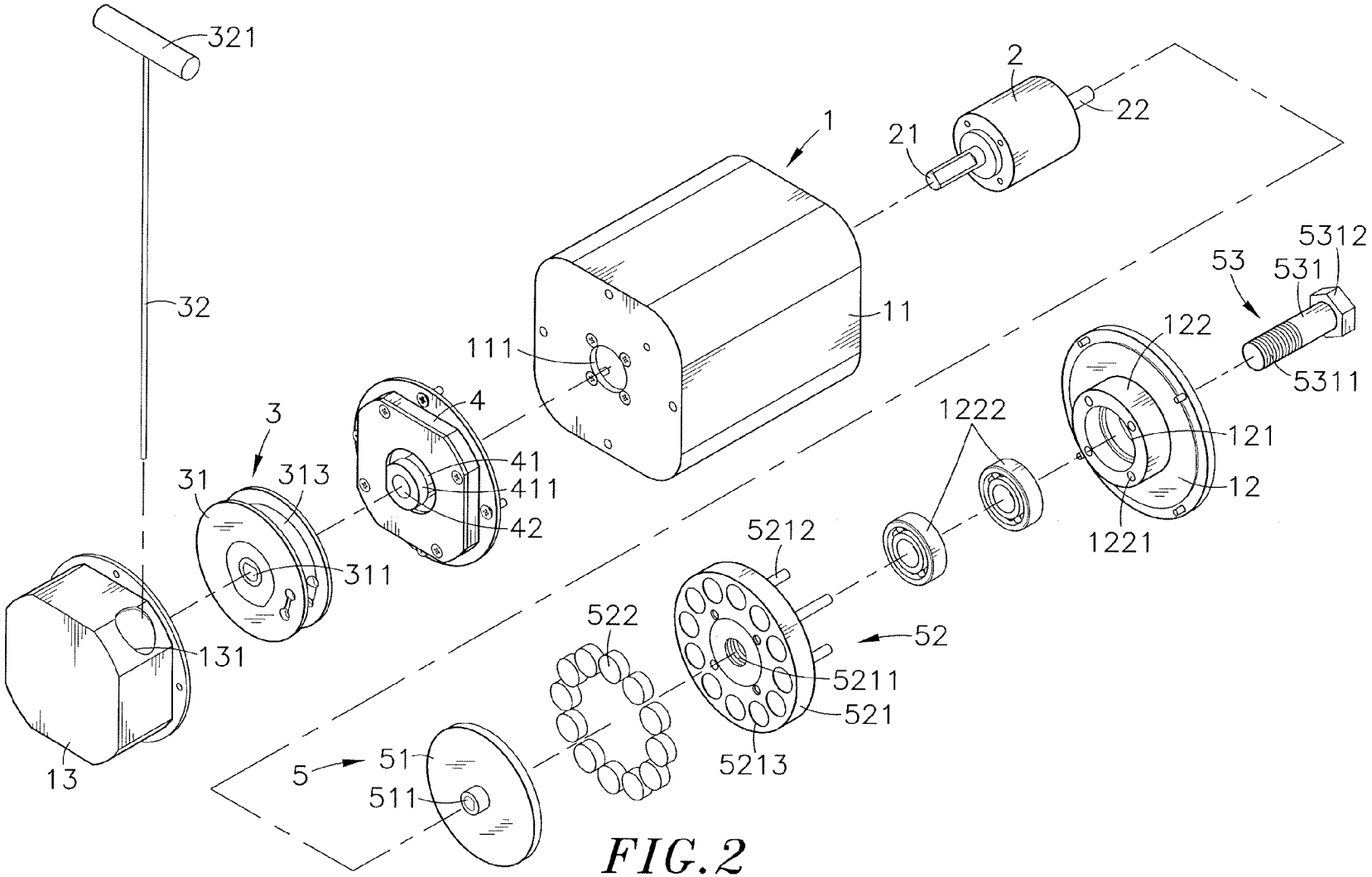
FIG. 2 is an exploded view of the present disclosure.
Figure 3:
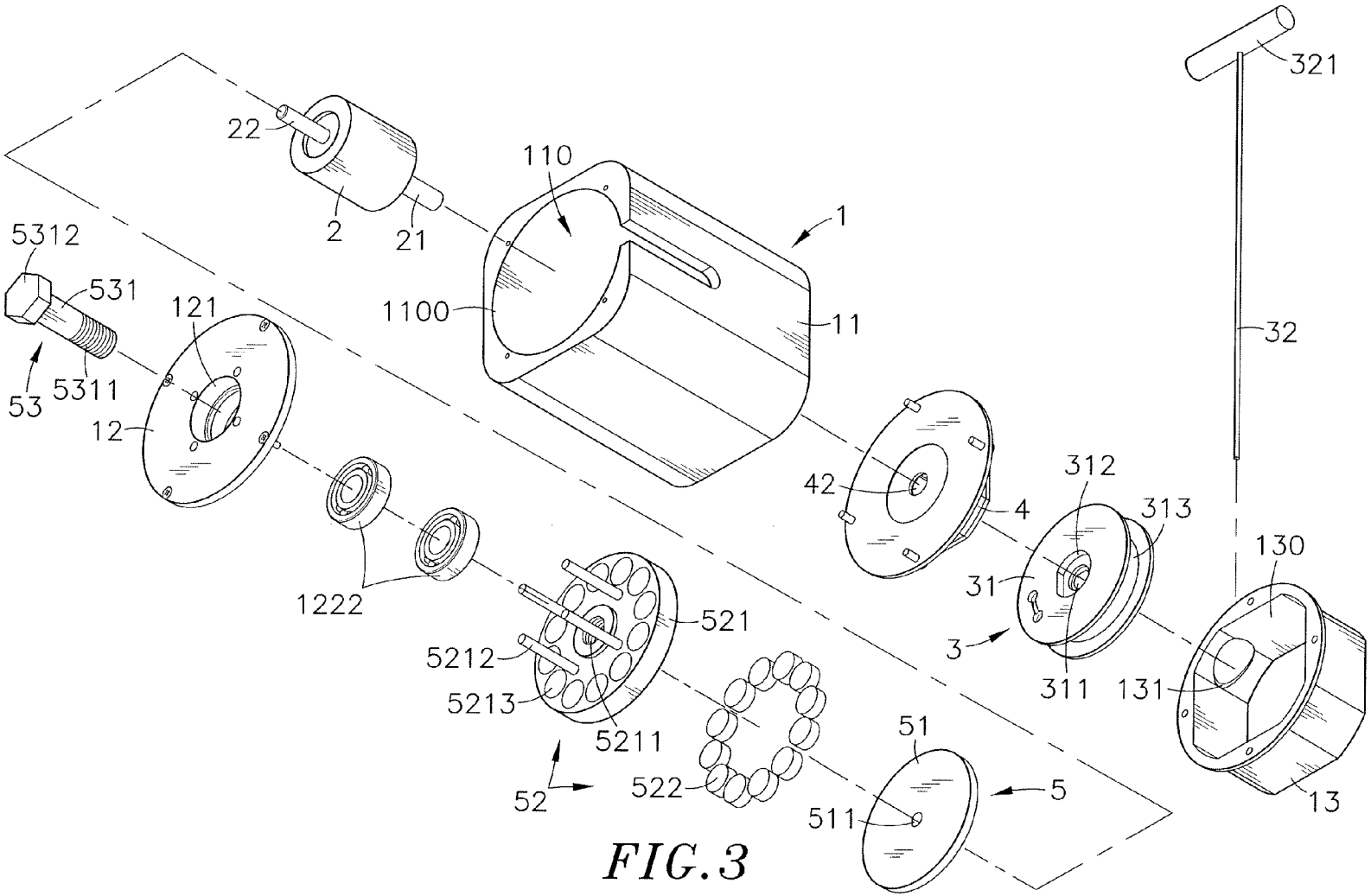
FIG. 3 is an exploded view from other view angle of the present disclosure.
Figure 4:
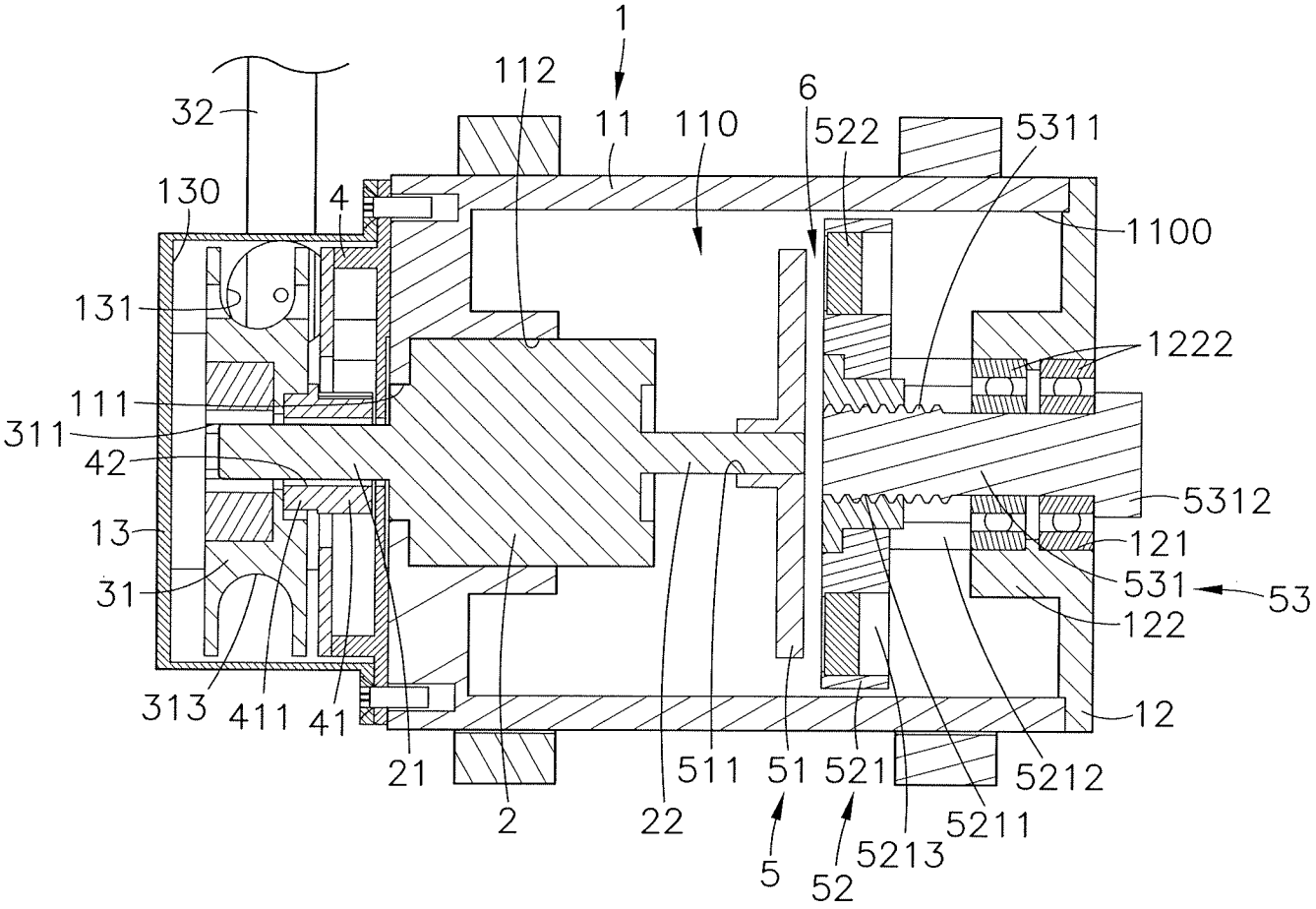
FIG. 4 is a lateral section view (A) of the present disclosure.
Figure 5:
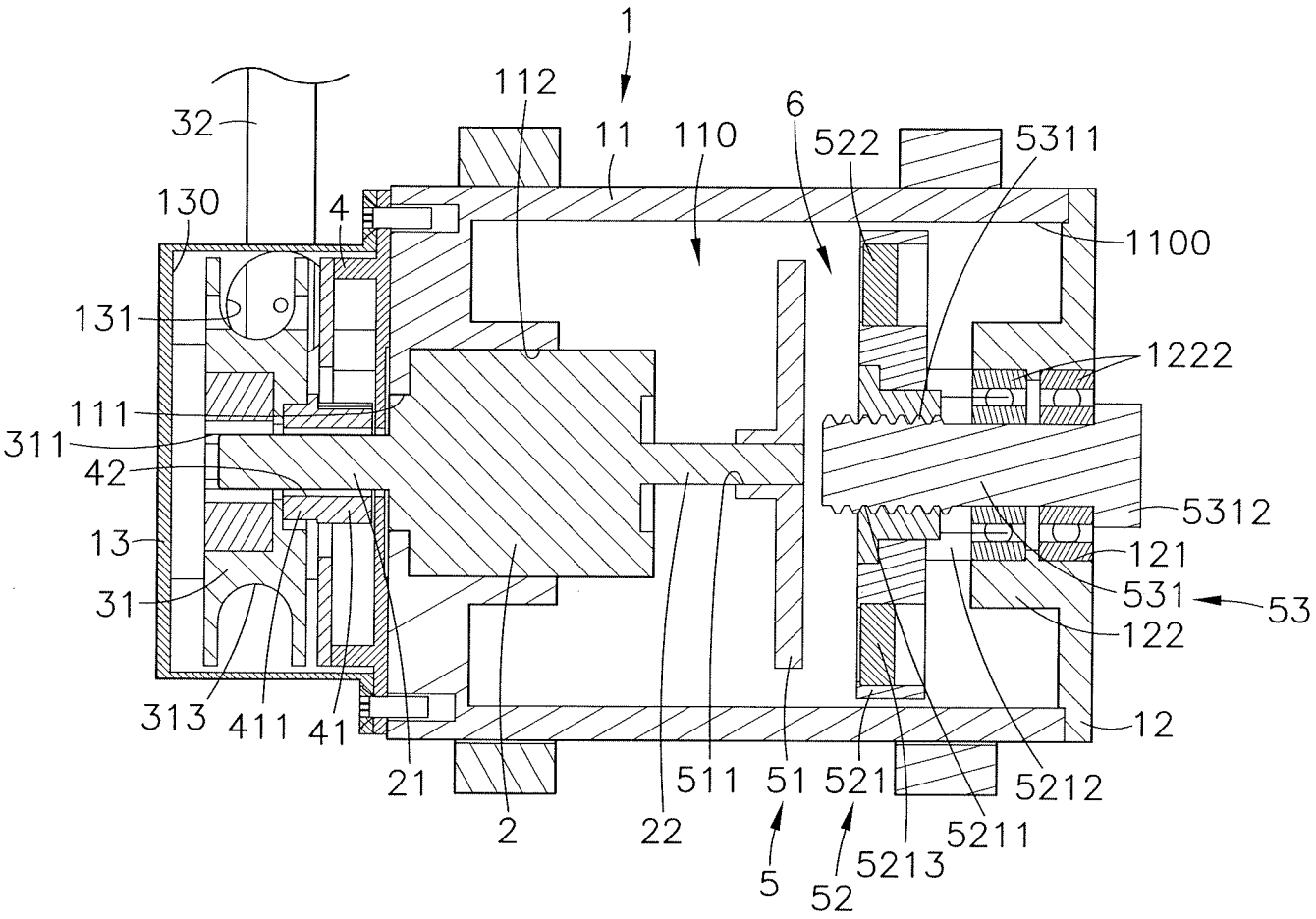
FIG. 5 is a lateral section view (B) of the present disclosure.

As shown in FIG. 2 and FIG. 3, the main shaft 21 and the first axis hole 311; the retarding shaft 22 and the second axis hole 511; the ring-like protrudent block 411 of the restoring wheel 41 and the clamping groove 312 of the wire wheel 31 respectively have structures matching with each other, such as surface structure fitting with peripheral structure of circle, so that the main shaft 21, the retarding shaft 22, and the ring-like protrudent block 411 can be inserted and fastened in the first axis hole 311, the second axis hole 511 and the clamping groove 312 respectively. It should be noted that the technology related to the axis column and axis hole used for insertion and fixation is a traditional technology, the detailed structure is not key point of the present disclosure, so the detailed description is omitted.

As shown in FIG. 2 and FIG. 3, the assembly of the base 11, the cover 12 and the covering structure 13; the assembly of the base 11 and the retarding mechanism 2; and the assembly of the base 11 and the restoring mechanism 4 all can be completed by using threaded holes and screws for screwing and fixation. The technology related to the threaded hole and screw used for screwing and fixation is a traditional technology, and the detailed structure is not the key point of the present disclosure, so the detailed description is omitted.

Figure 6:
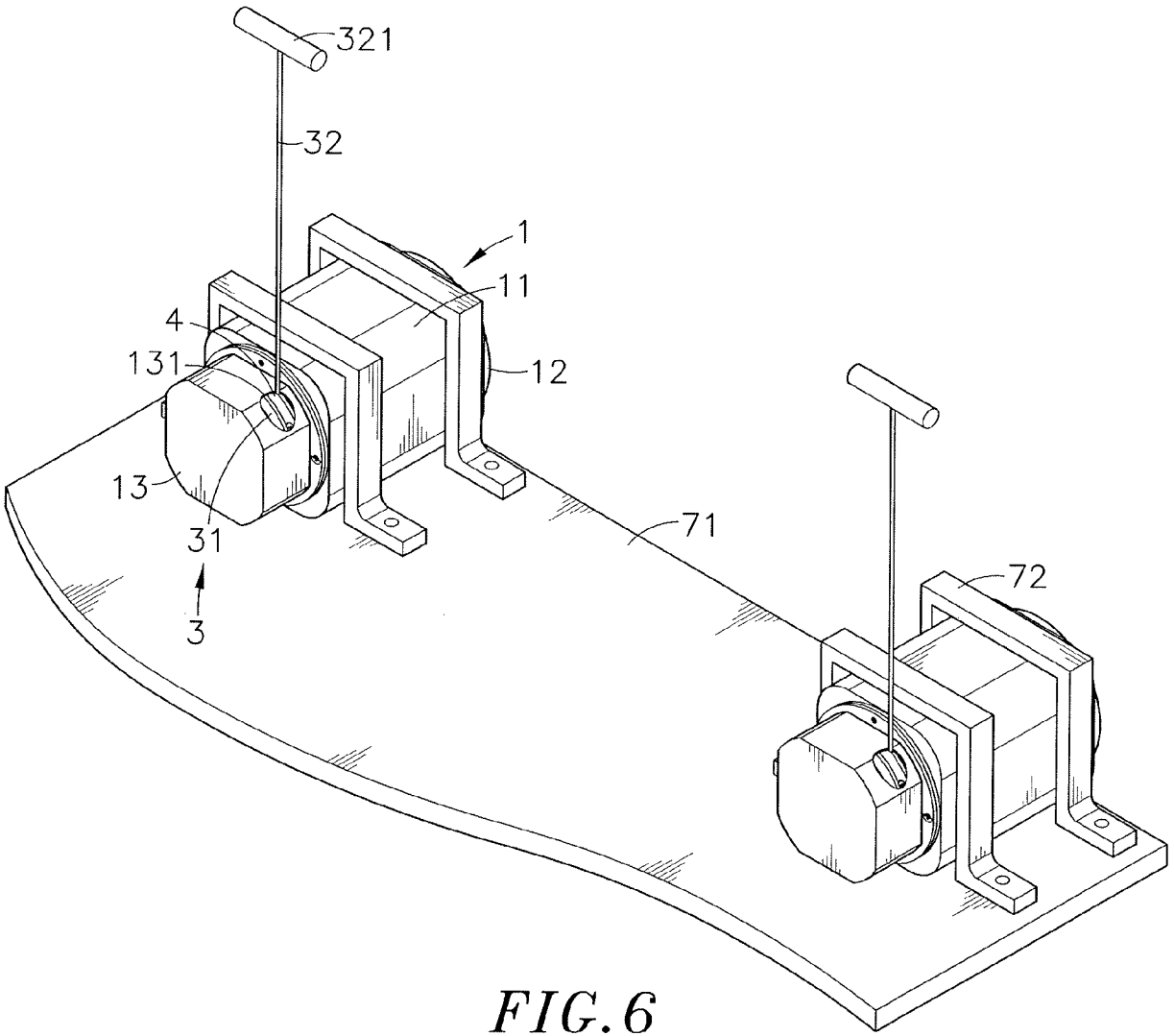
FIG. 6 is a perspective appearance view of a preferred embodiment of the present disclosure.
Figure 7:
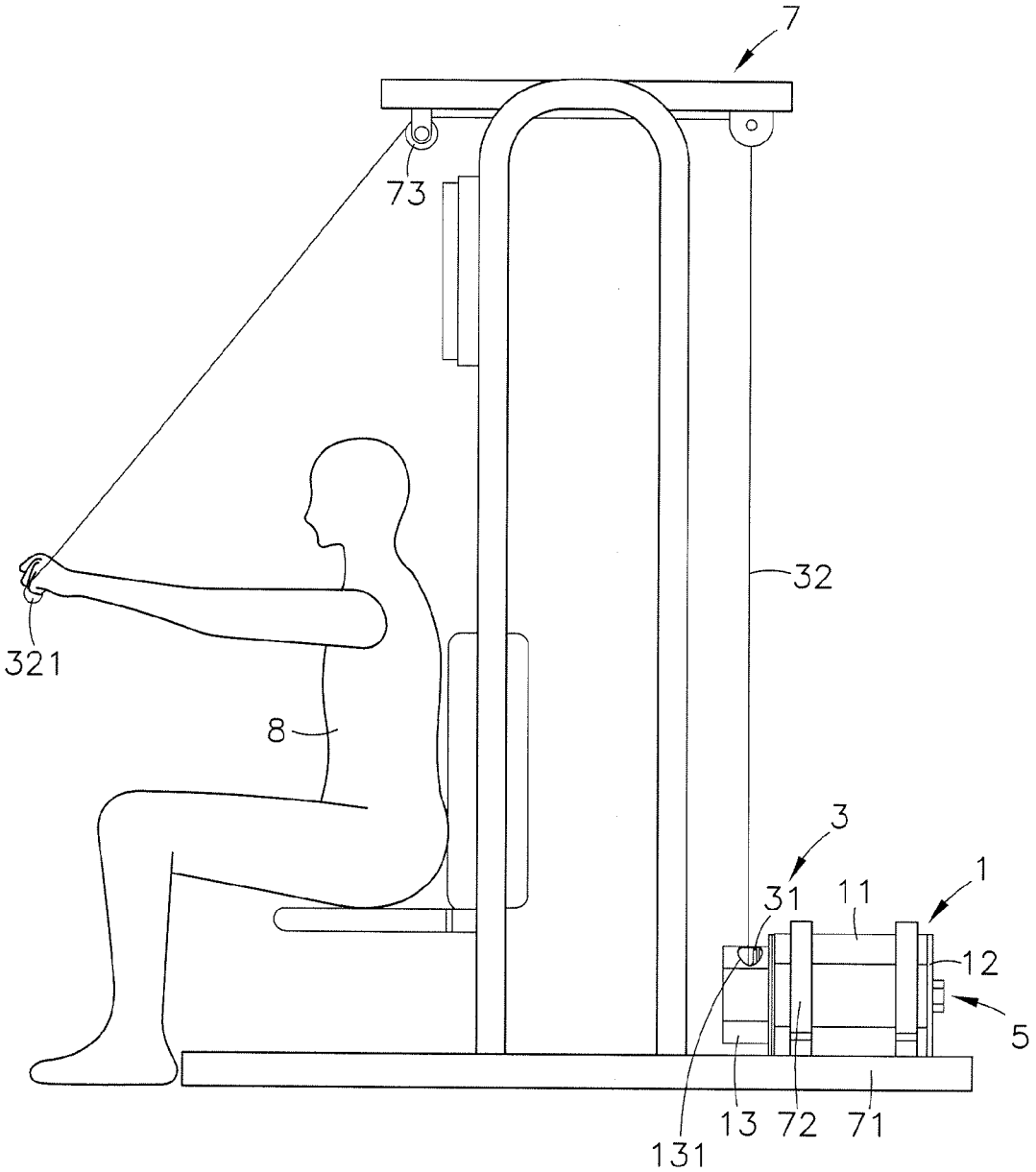
FIG. 7 is a lateral view of the present disclosure in use.
Figure 8:
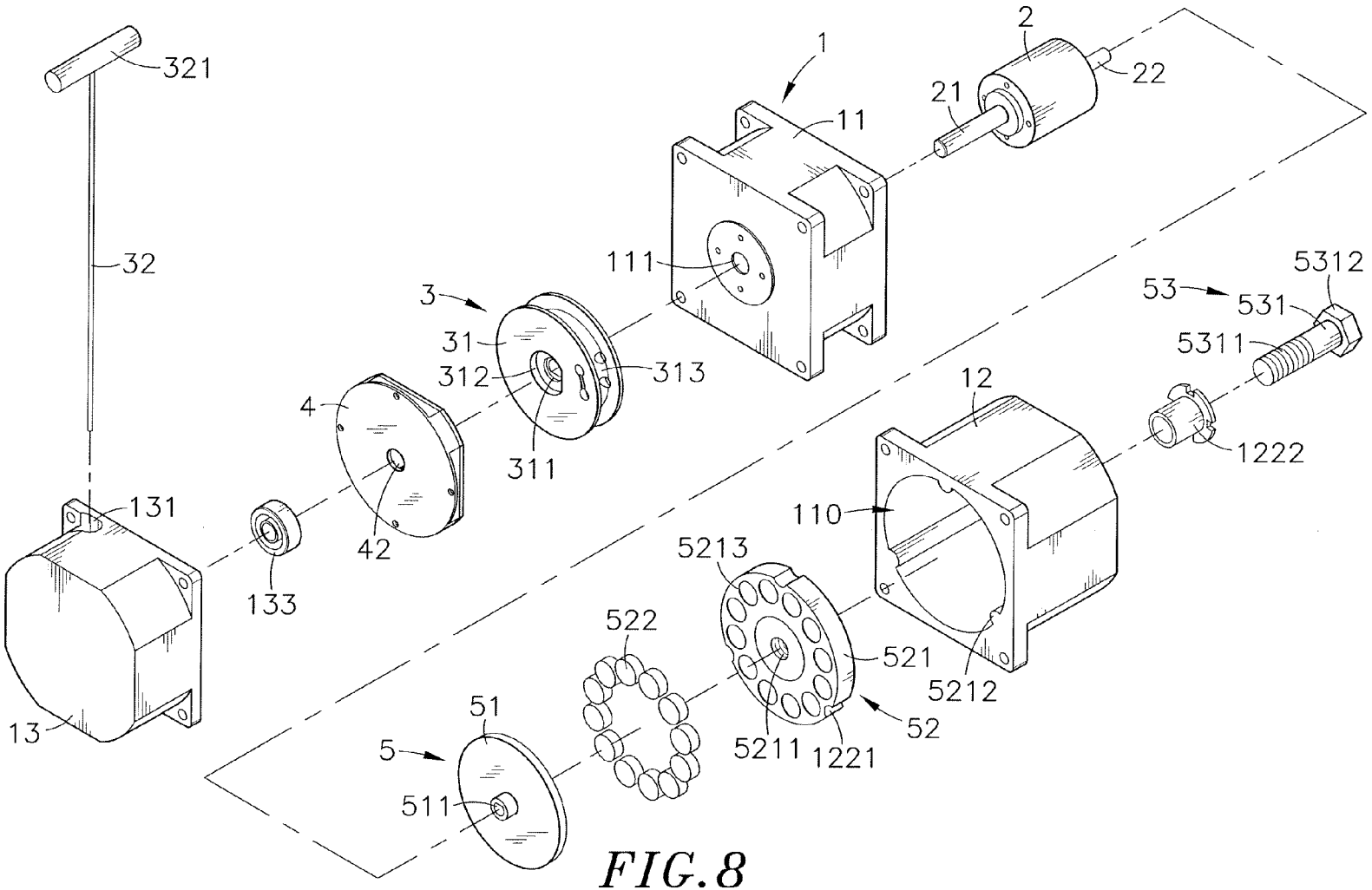
FIG. 8 is an exploded view of other embodiment of the present disclosure.

Please refer to FIGS. 6, 7 and 8 which show a perspective appearance view, a lateral view in using of a preferred embodiment and exploded view of other embodiment of the present disclosure. As shown in FIGS. 6, 7 and 8, in practical application, a pair of damping devices of the present disclosure are disposed on a bottom plate 71 of a machine frame 7, and a plurality of frame strips 72 are disposed on the bottom plate 71 to fix the two casing structure 1. The two pulling wires 32 are guided by a plurality of rollers 73 on the machine frame 7 to turn, so that the user can pulls the pulling handles 321 to execute strength training.

Before a user 8 executes the strength training, the user 8 can rotate the head portion 5312 of the adjusting bolt 531 to enable the outer screw thread 5311 of the adjusting bolt 531 to be screwed into or out the inner threaded hole 5211 of the load plate 521, so that the load plate 521 can be driven to be close to or away from the metal element 51, whereby a length of the interval 6 formed between the metal element 51 and the load plate 521 can be increased or reduced to further adjust the magnetic attraction applied on the metal element 51 by the magnets 522 inside the load holes 5213 of the load plate 521. The magnetic attraction is for use as a resistance applied on the pulling wires 32 pulled by the user 8 later.

While the user 8 executes the strength training, the user 8 pulls the pulling handles 321 of the pulling wires 32 by hands firstly, to enable the pulling wires 32 to drive the wire wheels 31 to rotate, so that the wire wheels 31 then drive the main shaft 21 and the restoring wheel to rotate toward a side, to further enable the main shaft 21 to act simultaneously with the retarding shaft 22 to rotate. Because the magnetic attraction exits between the magnets 522 and the metal elements 51 fixed at the metal element 51 of the retarding shaft 22, the user 8 must apply a pulling force larger than the magnetic attraction on the pulling wire 32 to pull the pulling wires 32, whereby the user completes the strength training action of hand one time.

The load plate 521 of the resistance mechanism 5 provided with the plurality of load holes 5213 on the surface thereof and arranged along the side edge thereof, and the plurality of load holes 5213 provided with magnets 522 respectively inside are just taken as preferred embodiments, but the claim scope of the present disclosure is not limited thereto. For practical application, the load plate 521 of the present disclosure can be provided with an annular space (not shown in FIGs) formed inside, and the annular space is provided with single annular magnet (not shown in FIGs) mounted inside. It requires that the magnetic attraction exists between the magnet 522 and the metal element 51 of the retarding shaft of for use as the resistance during the user pulling the pulling wire 32. It should be noted that various equivalent changes, alternations or modifications based on the claims of present disclosure are all consequently viewed as being embraced by the scope of the present disclosure.

When the user 8 pulls the pulling wire 32 to a preset location and stop applying the pulling force on the pulling handles 321 of the pulling wires 32, the restoring wheel 41 of the restoring mechanism 4 are winded to restore toward other side, so as to drive the wire wheel 31 to rotate to roll and receive the pulling wire 32 in the wire slot 313. Therefore, the user 8 can pull the pulling wire 32 to execute next strength training action later.

The user executing the strength training of hand by pulling the pulling wires 32 is just taken as a preferred embodiment. In practical application of the present disclosure, the plurality of rollers 73 can be arranged at different positions on the machine frame 7 to vary the positions of the pulling wires 32, to allow the user 8 to pull the pulling wires 32 for muscle training action of leg, shoulder, chest, back or buttocks respectively, as long as the magnetic attraction between the metal element 51 and the magnetic part 52 is used as the resistance for strength training action; however, the present disclosure is not limited thereto. It should be noted that various equivalent changes, alternations or modifications based on the claims of present disclosure are all consequently viewed as being embraced by the scope of the present disclosure.

Figure 9:
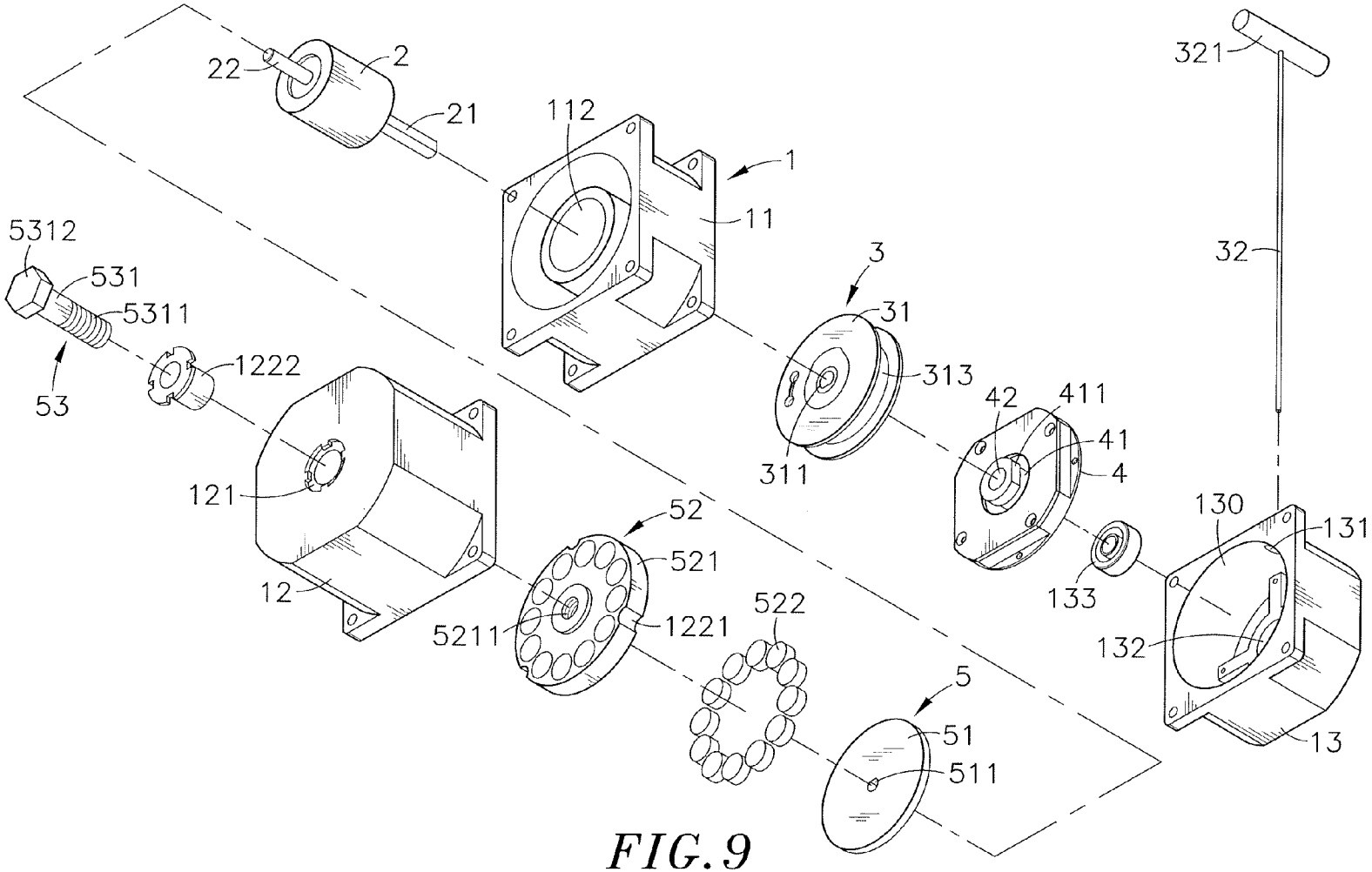
FIG. 9 is an exploded view from other view angle of the other embodiment of the present disclosure.
Figure 10:
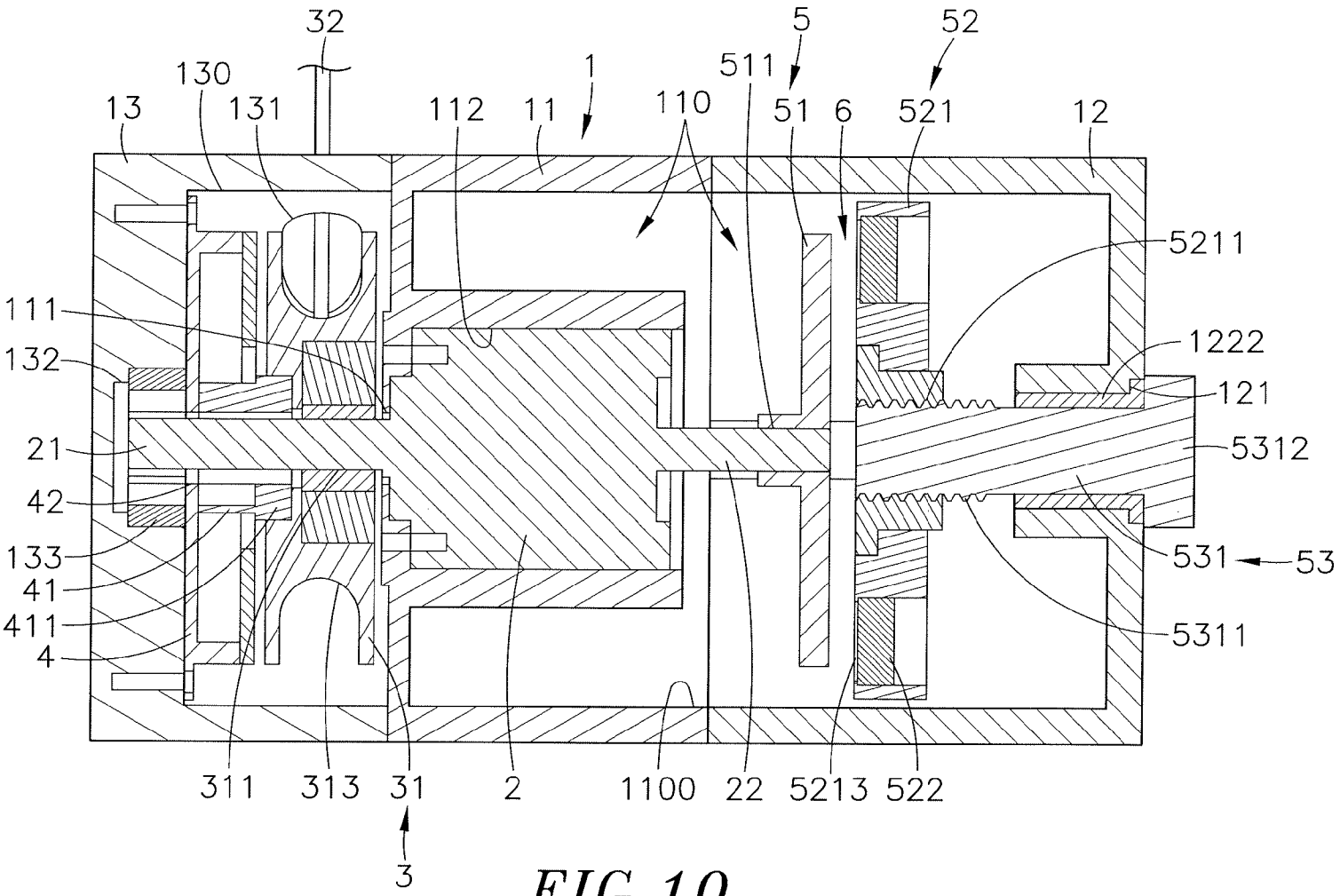
FIG. 10 is a lateral section view of the other embodiment of the present disclosure.

Please refer to FIG. 8 through FIG. 10 which show an exploded view, an exploded view by other view angle, and a lateral section view of another embodiment of the present disclosure. As shown in FIG. 8 through FIG. 10, an accommodating space 110 is formed between the base 11 of the casing structure 1 and the cover 12 to accommodate the members such as retarding mechanism 2, resistance mechanism 5 and etc. Moreover, the cover 12 can be designed without having the a plurality of positioning slots 1221 on the top of the annular positioning member 122, and the load plate 521 can be designed without having positioning pillars 5212 at a side surface thereof; but the accommodating space 110 is provided with a plurality of positioning pillars 5212 disposed around the inner surface thereof and the load plate 521 is provided with a plurality of positioning slots 1221 disposed around a periphery of the load plate 521, to enable the positioning pillars 5212 to be inserted into the positioning slots 1221 respectively. Therefore, when the adjusting bolt 531 is revolved, the load plate 521 can be acted limit slip along each of the positioning pillars 5212 by each of the positioning slots 1221 respectively. Moreover, arrangement of the driving mechanism 3 and the restoring mechanism 4 can be reverse to the original arrangement, that is, the driving mechanism 3 is located between the base 11 and the covering structure 13, and the restoring mechanism 4 is fastened at the bottom of the covering structure 13. The accommodating groove 130 of the covering structure 13 is provided with a groove portion 132 at the bottom thereof, and a bearing 133 is disposed in the groove portion 132. In practical application, the main shaft 21 of the retarding mechanism 2 is inserted into and fastened in the first axis hole 311 of the wire wheel 31 firstly and then suspended and passed through the channel 42 of the restoring mechanism 4, and the bearing 133 in the groove portion 132 is sleeved to the end of the main shaft 21. Therefore, after the user pulls the pulling wire 32, the wire wheels 31 drives the restoring wheel 41 to rotate, and the restoring wheels 41 are also winded to restore later, so as to drive the wire wheels 31 to rotate to roll the pulling wire 32 for accommodating the pulling wire 32 in the wire slots 313.

The retarding mechanism 2 of the present disclosure is provided with the metal elements 51 fastened at the retarding shaft 22, and the magnetic part 52 is disposed between the metal element 51 and the hollow-out hole 121, and the interval 6 is formed between the magnetic part 52 and the metal element 51. From outside of the casing structure 1, an adjusting member 53 is inserted into the hollow-out hole 121 to pivotally link with the magnetic part 52. In practical application, the load plate 521 can be driven by the adjusting member 53 to approach to or depart from the metal element 51, so as to increase or reduce the length of the interval 6 for adjusting the magnetic attraction applied on the metal element 51 by the magnetic part 52. When the user 8 pulls the pulling wires 32 to execute strength training, the interval 6 exists between the metal element 51 and the magnetic part 52, so any wear is not occurred between the metal element 51 and the magnetic part 52, whereby the damage on the resistance mechanism 5 can be reduced and further improve the life time of damping device of the present disclosure.

The above-mentioned content is just a preferred embodiment of the present disclosure, but the patent scope of the present disclosure is not limited thereto. The present disclosure is mainly directed to the damping device which includes a casing structure 1, a retarding mechanism 2, a driving mechanism 3, a restoring mechanism 4 and a resistance mechanism 5. Because an interval 6 is formed between a magnetic part 52 of the resistance mechanism 5 and a metal element 51, the user can pull pulling wires 32 of a wire wheel 31 to execute the strength training, and no wear will be occurred between the metal element 51 and the magnetic part 52, and the damage occurred on the resistance mechanism 5 can be reduced.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A damping device, comprising a casing structure, a retarding mechanism, a driving mechanism, a restoring mechanism and a resistance mechanism, said casing structure provided with an accommodating space formed inside, and said accommodating space provided with a through hole and a hollow-out hole formed at walls of two opposite sides thereof and corresponding to each other;

said retarding mechanism located within said accommodating space, and provided with a main shaft disposed at a side thereof and passed through said through hole, and a retarding shaft disposed at other side thereof and located within said accommodating space and acting simultaneously with said main shaft;

said driving mechanism located outside of said casing structure, and provided with a wire wheel fastened on said main shaft, and a pulling wire wound at a periphery of said wire wheel and configured to be pulled by a user;

said restoring mechanism located near said driving mechanism, and provided with a restoring wheel disposed at a side thereof and fastened with said wire wheel and a channel passed other side therethrough, and said main shaft inserted into said channel; and said resistance mechanism provided with a metal element fastened at said retarding shaft, and a magnetic part disposed between said metal element and said hollow-out hole, and an interval formed between said magnetic part and said metal element, and an adjusting member inserted into said hollow-out hole from outside of said casing structure and pivotally linked with said magnetic part.

2. The damping device as defined in claim 1, wherein said casing structure has a base, and said base is provided with said accommodating space formed therein, an opening is formed at one side of said accommodating space, said through hole is formed on a central area of a wall surface of other side opposite to said opening, and said through hole is provided with a sleeved groove protrudingly disposed at a periphery surface thereof toward said accommodating space, and a cover is mounted on said opening and provided with said hollow-out hole at a central area thereof and corresponding to said through hole.

3. The damping device as defined in claim 2, wherein said base is provided with a covering structure mounted on the outside of said through hole, and said covering structure is provided with an accommodating groove concavely formed at a side thereof for accommodating said driving mechanism and said restoring mechanism, and said accommodating groove is provided with an outlet hole at a wall surface of a side thereof to enable said pulling wire to be passed therethrough.

4. The damping device as defined in claim 2, wherein said cover is provided with an annular positioning member protrudingly disposed at a surface of a periphery of said hollow-out hole, and said annular positioning member is provided with a plurality of positioning slots at a top thereof, and said magnetic part of said resistance mechanism comprises a load plate which is provided with a plurality of positioning pillars protrudingly disposed at a side surface thereof and inserted into the plurality of positioning slots and provided with load holes passed through said side surface thereof and disposed along a side edge thereof, and magnets are assembled within said load holes respectively.

5. The damping device as defined in claim 4, wherein said load plate is provided with an inner threaded hole at a central area thereof, and said adjusting member is an adjusting bolt which is provided with an outer screw thread disposed at a side thereof and revolved relatively to said inner threaded hole to adjust an interval between said load plate and said metal element, and said adjusting bolt is provided with a head portion disposed at other side thereof and clamped against an outer surface of said hollow-out hole of said cover.

6. The damping device as defined in claim 5, wherein said annular positioning member of said cover is provided with one or more bearing mounted at an inner side thereof and sleeved onto said adjusting bolt.

7. The damping device as defined in claim 1, wherein said wire wheel of said driving mechanism is provided with a first axis hole at a central area thereof for said main shaft to be passed and fastened through said first axis hole, and said metal element is provided with a second axis hole at a central area thereof for said retarding shaft to be passed and fastened through said second axis hole.

8. The damping device according to claim 7, wherein said wire wheel is provided with a clamping groove concavely formed at a side surface of a central area thereof and an outer diameter of said clamping groove is larger than an outer diameter of said first axis hole, and said restoring wheel of said restoring mechanism is provided with a ring-like protrudent block protrudingly disposed at a periphery of a top thereof and clamped and fastened in said clamping groove.

9. The damping device according to claim 7, wherein said wire wheel is provided with a wire slot formed at a periphery thereof for said pulling wire to be rolled and accommodated, and an end of said pulling wire is fastened in said wire slot and said pulling wire is provided with a pulling handle at other end thereof.

10. The damping device as defined in claim 2, wherein said base of said casing structure is provided with said sleeved groove formed therein for said retarding mechanism to be clamped and positioned, and said base and said cover can be assembled to form said accommodating space therein to accommodate said retarding mechanism and said resistance mechanism.

11. The damping device as defined in claim 10, wherein said casing structure is provided with a plurality of positioning pillars around disposed at an inner surface of said accommodating space of said cover, and said magnetic part of said resistance mechanism comprises a load plate which is provided with a plurality of positioning slots disposed around a periphery of said load plate, and said positioning pillars inserted into said positioning slots, and said load plate is provided with a plurality of load holes passed through a surface thereof and disposed along a side edge thereof, and magnets are assembled within said load holes respectively.

12. The damping device as defined in claim 10, wherein said base is provided with a covering structure mounted outside of said through hole, and said covering structure is provided with an accommodating groove concavely formed in a side thereof for accommodating said driving mechanism and said restoring mechanism, and said accommodating groove is provided with an outlet hole at a wall surface of a side thereof for said pulling wire to pass therethrough, said accommodating groove of said covering structure is provided with a groove portion at a bottom thereof, said bearing is disposed in said groove portion and sleeved on an end of said main shaft, and said driving mechanism is located between said base and said covering structure, and said restoring mechanism is fastened at a bottom of the covering structure.

* * * * *